US006098823A

United States Patent [19]

Yahiaoui

[11] Patent Number: 6,098,823

[45] **Date of Patent: *Aug. 8, 2000**

[54] STABILIZING ARRANGEMENTS IN AND FOR LOAD-BEARING APPARATUS

[75] Inventor: Mohamed Yahiaoui, Hagerstown, Md.

[73] Assignee: JLG Industries, Inc., McConnellsburg, Pa.

[ * ] Notice: This patent issued on a continued prosecution application filed under 37 CFR 1.53(d), and is subject to the twenty year patent term provisions of 35 U.S.C. 154(a)(2).

[21] Appl. No.: 09/031,272

[22] Filed: Feb. 27, 1998

[51] Int. Cl.[7] ..... B66C 23/76

[52] U.S. Cl. ..... 212/197; 212/279; 182/2.9

[58] Field of Search ..... 212/195, 198, 212/196, 279, 256, 197; 162/2.9, 7.11

[56] References Cited

U.S. PATENT DOCUMENTS

| | | | |
|---|---|---|---|
| Re. 31,400 | 10/1983 | Rallis et al. . | |
| 200,898 | 3/1878 | De Celis | 212/198 |
| 1,245,186 | 11/1917 | Brothers | 212/196 |
| 2,015,604 | 9/1935 | Molinelli | 212/279 |
| 2,526,613 | 10/1950 | Tanguy | 212/279 |
| 2,666,417 | 1/1954 | Harsch . | |
| 3,185,316 | 5/1965 | Bennett | 212/196 |
| 3,198,359 | 8/1965 | Lull . | |
| 3,445,014 | 5/1969 | Kullerback . | |
| 3,509,965 | 5/1970 | Mitchell . | |
| 3,713,544 | 1/1973 | Wallace . | |
| 3,768,665 | 10/1973 | Eiler et al. . | |
| 3,861,498 | 1/1975 | Grove . | |
| 3,938,669 | 2/1976 | Vinton . | |
| 3,967,744 | 7/1976 | Goyarts . | |
| 4,070,807 | 1/1978 | Smith, Jr. . | |
| 4,147,263 | 4/1979 | Frederick et al. . | |
| 4,226,300 | 10/1980 | Rallis et al. . | |
| 4,245,441 | 1/1981 | Smith, Jr. . | |
| 4,268,216 | 5/1981 | Copie . | |
| 4,278,390 | 7/1981 | Ahearn . | |
| 4,664,585 | 5/1987 | Ambridge et al. . | |
| 4,773,814 | 9/1988 | Brocklebank et al. | 212/198 |
| 4,991,673 | 2/1991 | Ericsson . | |
| 5,518,128 | 5/1996 | Kröll et al. . | |

FOREIGN PATENT DOCUMENTS

| | | | |
|---|---|---|---|
| 38376 | 1/1936 | Netherlands | 212/256 |
| 205245 | 1/1968 | U.S.S.R. | 212/198 |
| 1225805 | 4/1986 | U.S.S.R. | 212/279 |
| 1539162 | 1/1990 | U.S.S.R. | 212/195 |

*Primary Examiner*—Thomas J. Brahan
*Attorney, Agent, or Firm*—Reed Smith Shaw & McClay LLP

[57] ABSTRACT

An arrangement in or for a boom lift or other type of lift or load-bearing apparatus, in which a stabilizing moment is imparted based on at least one state of at least a portion of the boom or other portion of the lift or load-bearing apparatus. Also contemplated is an arrangement for redistributing mass responsively, based on at least one state of at least a portion of a load-bearing apparatus.

10 Claims, 12 Drawing Sheets

STABILIZING ARRANGEMENTS IN AND FOR LOAD-BEARING APPARATUS

FIELD OF THE INVENTION

The present invention generally relates to lift structures and/or load-bearing vehicles.

BACKGROUND OF THE INVENTION

Historically, there have been developed a wide range of lift structures that are arranged in such a manner as to elevate personnel or material in order to provide facilitated access to an elevated location.

Different types of lifts vary in size, shape and function. For example, "vertical pole" lifts generally involve the use of a telescoping mast or sequentially extending mast (in which mast segments are usually "stacked" along a horizontal direction and then propagate upwardly one-by-one), on which is mounted a basket, cage or other platform structure intended to carry one or more individuals. Most "vertical pole" lifts are intended to carry only one individual, however, and are generally designed to elevate solely in a vertical direction. U.S. Pat. No. 3,752,261 (Bushnell, Jr.), U.S. Pat. No. 4,657,112 (Ream et al.) and U.S. Pat. No. 4,015,686 (Bushnell, Jr.) disclose general examples of such lifts.

"Scissors lifts", on the other hand, involve the use of a scissors-type mechanism for propagating a basket, cage or platform upwardly. Again, the propagation is solely along a generally vertical direction, but in this case the more rigid structure of the scissors mechanism permits greater loads to be propagated and carried. U.S. Pat. No. 5,390,760 (Murphy) and U.S. Pat. No. 3,817,846 (Wehmeyer) disclose general examples of such lifts.

"Boom lifts" involve the use of a pivotable, and often extendible, boom structure to propagate a basket, cage or platform both upwardly and in a variety of other directions. U.S. Pat. No. 3,861,498 (Grove) and Re. 31,400 (Rallis, et al.) disclose general examples of such lifts.

Other types of lifts, not typically falling into one of the three categories outlined above, can also be used for similar purposes, that is, for propagating personnel or material in a generally upward direction to access an elevated workspace. U.S. Pat. Nos. 4,488,326 (Cherry), U.S. Pat. No. 3,927,732 (Ooka et al.), U.S. Pat. No. 5,299,653 (Nebel), U.S. Pat. No. 4,154,318 (Malleone), U.S. Pat. No. 4,799,848 (Buckley) and U.S. Pat. No. 4,147,263 (Frederick et al.) disclose general examples of lifts outside of the three categories discussed above.

Many types of vehicles and lift structures, especially boom lifts, excavators, cranes, backhoes, and other similar machines, have centers of mass that migrate significantly during use. In contrast, automobiles and similar vehicles have their lateral centers of mass located at some point substantially along the longitudinal axes thereof and these tend not to migrate significantly at all. Thus, a migrating center of mass has been a perennial problem with certain vehicles or machines, including boom lifts.

In the instant disclosure, the terms "boom" and "load-bearing arm" may each be taken to be indicative of essentially any device or instrument that provides extended reach, either for the purpose of moving personnel for doing work, for or moving goods, or both. Thus, in the instant application, the term "boom" not only can be taken to be indicative of a telescoping and/or articulated boom in a boom lift, but might also include those types of mechanical extensions found in essentially any of the equipment described or referred to herein, such as, for example, excavators, cranes, backhoes, tree harvesters, mechanical pincers and other similar machines.

Throughout the instant disclosure, reference will also be made to the angle that a boom or lower portion of a boom (e.g., a base boom of a straight [telescopic] boom lift or a tower boom of an articulated boom lift) forms with the horizontal. Conventionally, this is often termed the "lift angle", "vertical angle" or "elevation angle". Each of these terms may be considered to be interchangeable with respect to one another.

As a boom is extended and a load is applied to the platform or bucket thereof, the vehicle or lift structure's center of mass moves outwardly toward the supporting wheels, tracks, outriggers or other supporting elements being used. If a sufficient load is applied to the boom, the center of mass will move beyond the wheels or other supporting elements and the vehicle lift will tip over. The imaginary line along a support surface (e.g., the ground) about which a vehicle tips is known as the "tipline". A more detailed discussion of the principles of tipping is provided in copending and commonly assigned U.S. patent application Ser. No. 08/890,863, which is hereby incorporated by reference as if set forth in its entirety herein.

By defining the tipline of a lift or vehicle as near to the perimeter of the lift or vehicle's chassis as possible, the stability of the lift or vehicle is increased. This increase in stability permits the lift or vehicle to perform its intended function with the minimum amount of necessary counterbalance weight, which results in lower costs, improved flotation on soft surfaces, easier transport, etc.

In the context of booms, two types of stability are generally addressed, namely "forward" and "backward" stability. "Forward" stability refers to that type of stability addressed when a boom is positioned in a maximally forward position. In most cases, this will result in the boom being substantially horizontal. On the other hand, "backward" stability refers to that type of stability addressed when a boom is positioned in a maximally backward position (at least in terms of the lift angle). In most cases, this will result in the boom being close to vertical, if not completely so.

Typically, not only can a boom be displaced (i.e., pivoted) through a vertical plane, but also through a horizontal plane. In a boom lift, for example, the horizontal positioning is usually effected via a turntable that supports the boom. The turntable, and all components propelled by it (including the boom and work platform), are often termed the "superstructure". As the wheeled chassis found in typical lift arrangements will usually not exhibit complete circumferential symmetry of mass, it will be appreciated that there exist certain circumferential positions of the boom that are more likely to lend themselves to potential instability than others. Thus, in the case of a lift in which the chassis or other main frame does not exhibit symmetry of mass with regard to all possible circumferential positions of the boom, then a greater potential for instability will exist, for example, along a lateral direction of the chassis or main frame, that is, in a direction that is orthogonal to the longitudinal lie of the chassis or main frame (assuming that the "longitudinal" dimension of the chassis or main frame is defined as being longer than the "lateral" dimension of the chassis or main frame). Thus, when incorporating safety requirements into the lift, these circumferential positions of maximum potential instability must be taken into account.

Throughout the instant disclosure, reference will often be made to the circumferential position assumed by a boom or a main boom portion (e.g., a base boom of a straight [telescopic] boom lift or a tower boom and an articulated boom lift). This circumferential position is often referred to as the "swing" or "slew" of the boom, but may also be referred to as the "horizontal angle" or "circumferential angle" of the boom. All of these terms may be considered to be interchangeable with one another.

Historically, it has been the norm to ensure the presence of a counterweight to the boom. In this manner, when the boom is in a maximally forward position, the counterweight will help counteract the destabilizing moment contributed to by the boom (with personnel or material load).

In theory, a counterweight may involve any component or components that, when situated appropriately with respect to the boom, serve to counterbalance the boom. In practice, it has been quite common to provide a dedicated counterweight that is an integral portion of the turntable structure. However, it is possible to use any of several components either as a singular counterweight or as part of a composite counterweight. Such components include, but are not limited to, the turntable itself, a shell disposed about the turntable, an engine disposed within the vehicle chassis, or other relatively massive components that simultaneously form a functioning part of the chassis or turntable. It is to be understood that, throughout this disclosure, "counterweight" can be taken to mean either a dedicated object specifically provided for the purpose of counterbalancing a boom and essentially serving no other purpose, or other objects such as those just described, or any combination of items from both of these categories.

The use of a counterweight does have somewhat of an opposite consequence, however, when one considers the issue of backward instability. Particularly, when a boom is moved into a maximally backward position, it will be appreciated that a destabilizing moment, contributed to by the boom (with personnel or material load) and counterweight, could act in a backward direction. On the other hand, if a destabilizing moment is not present, even a small net stabilizing moment might be undesirable. Thus, it has been the norm to accord the chassis or other main frame an even greater weight than might be desired, for the purpose of counterbalancing the destabilizing moment that contributes to backward instability.

Although the measures described hereinabove have conventionally been sufficient to reduce the risk of tipping in either a forward or a backward direction, concern has arisen in the industry over the costs associated with providing an overly massive chassis or frame. The mass of a chassis or frame not only has ramifications in manufacturing costs, but also in transport costs or in other factors, such as the load that might be applied to fragile surfaces (e.g., mud or sand). Accordingly, a need has been recognized in conjunction with keeping such additional mass to a minimum.

At times, however, concerns over the mass of a chassis or frame might be overridden by concerns over the work envelope, or reach, of the load-bearing apparatus in question. In such instances, a need has been recognized in conjunction with increasing the available work envelope, or reach, of a load-bearing apparatus, for a given mass of the apparatus.

A need has additionally been recognized in conjunction with optimizing a load-bearing apparatus so as to provide a reduced weight and increased work envelope, or reach, deemed appropriate for the intended tasks to be performed by the load-bearing apparatus.

Some previous efforts have attempted to reduce the likelihood of tipping via one or more movable portions of the vehicle or machine in question. For example, U.S. Pat. No. 3,768,665, to Eiler et al., appears to disclose a mobile crane with a jib mounted on a rotatable element and a counterweight connected to an inner end of the jib by connecting links. It is also disclosed that, to avoid tipping of the vehicle, the jib and the counterweight can be moved to fore and aft positions. However, the movement of the counterweight is completely independent of any other factors, such as the position of the jib.

Some previous efforts involve the translation of boom structures in a single direction, but only for the purpose of repositioning the boom structure to alter the available "work envelope", or the reach afforded by the boom structure. Generally, such efforts have resulted in structures that might involve undesirable inefficiencies of movement or adjustment, or might be limited in their capabilities.

In this regard, U.S. Pat. No. 4,147,263, to Frederick et al., involves a high lift loader that permits longitudinal repositioning of the telescoping structure. However, the repositioning is one-dimensional in nature and is completely independent of any other physical parameters of the machine (e.g. a physical state of the boom).

In an apparent effort to facilitate upward travel in a lift, U.S. Pat. No. 4,070,807, to Smith, Jr. appears to disclose an arrangement for ensuring that a personnel bucket travels substantially in a vertical line (e.g. along a wall), irrespective of the orientation of the boom structure supporting it. In this way, a continual adjustment is made, responsive to the effective vertical angle of the boom structure, to push the bucket outwardly or inwardly so that, instead of describing an arc as would normally be expected, it follows nearly a straight line on the way up or down.

As part of this effort, a portion of the device is capable of sliding, but only in a horizontal direction corresponding to the longitudinal direction of the lift. However, there is no teaching or suggestion that this action could or should be part of an effort to compensate for any destabilizing moments, and for this reason the range of movement of the boom structure might be highly limited. Furthermore, the objective of maintaining substantially straight-line travel might come at the expense of actually reducing the work envelope (i.e., available reach) of the boom.

SUMMARY OF THE INVENTION

Generally, at least one presently preferred embodiment of the present invention broadly contemplates load-bearing apparatus comprising: a load-bearing arm; and an arrangement for imparting to the apparatus a stabilizing moment based on at least one state of at least a portion of the load-bearing arm.

Further, at least one presently preferred embodiment of the present invention broadly contemplates a boom lift comprising: a boom; and an arrangement for imparting to the boom lift a stabilizing moment based on at least one state of at least a portion of the boom.

Additionally, at least one presently preferred embodiment of the present invention broadly contemplates load-bearing apparatus comprising: a load-bearing portion; and an arrangement for imparting to the load-bearing apparatus a stabilizing force, based on at least one state of the load-bearing portion.

Further, at least one presently preferred embodiment of the present invention broadly contemplates load-bearing apparatus comprising an arrangement for responsively redistributing mass based on at least one state of at least a portion of the load-bearing apparatus.

Finally, but not necessarily exclusively, at least one presently preferred embodiment of the present invention broadly contemplates load-bearing apparatus comprising: a load-bearing arm; an arrangement for supporting said load-bearing apparatus on a surface; and an arrangement for imparting to the apparatus a reduction in structural loading as experienced at the interface between the supporting arrangement and the surface on which the load-bearing apparatus is supported.

BRIEF DESCRIPTION OF THE DRAWINGS

The present invention and its presently preferred embodiments will be better understood by way of reference to the detailed disclosure herebelow and to the accompanying drawings, wherein.

DESCRIPTION OF THE PREFERRED EMBODIMENTS

Throughout the instant disclosure, it will be appreciated that several terms may be used interchangeably with one another, some of which are briefly discussed immediately below.

The terms "basket", "cage", "platform", "work platform", "working platform", "platform structure", "bucket" and "carriage" are all indicative of portions of a lift structure on or in which one or more individuals, or a load of material, may be positioned so as to be raised to an elevated location. It is to be understood that the occurrence of any of these terms singly can be taken to indicate the interchangeability therewith of any of the other terms.

The terms "slide" and "translate", and their verbal conjugations (e.g., "sliding", "slideable", "translating", etc.), as employed herein, are interchangeable and are indicative of a strictly translational type of movement undertaken by a given component or components.

FIGS. 1–4*c* are schematic representations of boom lifts that are intended to convey some basic concepts relating to the prior art and to at least one embodiment of the present invention. As such, it is to be understood that FIGS. 1–4*c* are not necessarily to scale and that the dimensions, proportions and positional relationships illustrated therein might be exaggerated or diminished simply to assist in illustrating such basic concepts.

Figure 1:
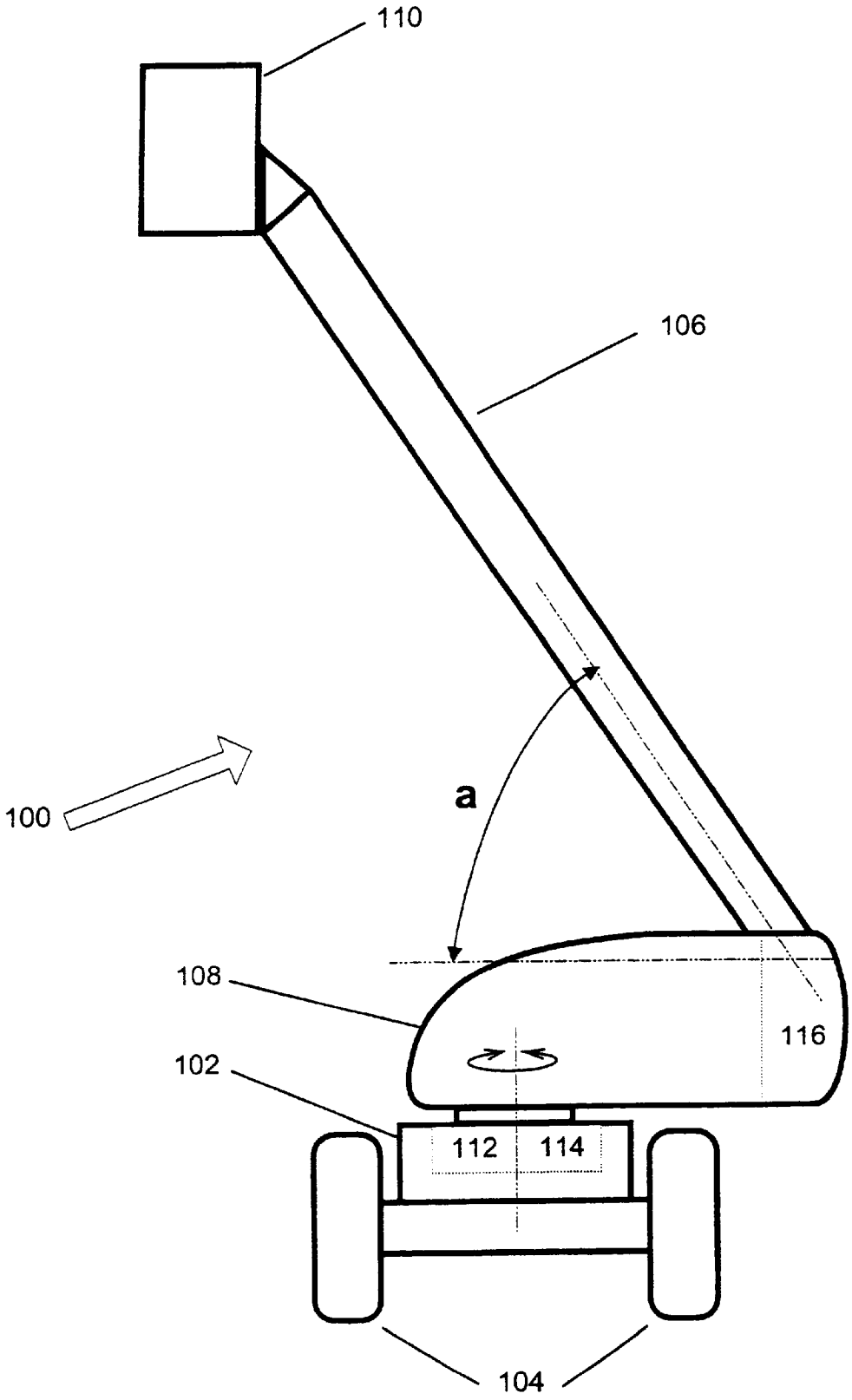
FIG. 1 is a schematic elevational representation of a lift structure and associated components.

FIG. 1 schematically illustrates a typical boom lift 100 that might employ the present invention in accordance with at least one presently preferred embodiment. As is known conventionally, a chassis 102 is supported on wheels 104. Conceivable substitutes for wheels 104 might be tracks (similar to the type found in a military tank), skids, outriggers or other types of fixed or movable support arrangements. A boom 106, extending from turntable 108, will preferably support at its outer end a platform 110. Turntable 108 may preferably be configured to effect a horizontal pivoting motion, as indicated by the arrows, in order to selectively position the boom 106 at any of a number of circumferential positions lying along a horizontal plane. There is preferably a drive arrangement 112 (such as a slew or swing drive) to effect the aforementioned horizontal pivoting motion. On the other hand, there is also preferably provided a drive arrangement 114 (such as a lift cylinder) for pivoting the boom 106 along a generally vertical plane, to establish the position of boom 106 at a desired vertical angle a. The drive arrangements 112 and 114 could be operationally separate from one another or could even conceivably be combined into one unit performing both of the aforementioned functions. As mentioned previously, the turntable 108 and all components propelled by it (including the boom 106 and platform 110) are often termed the "superstructure".

Preferably, the turntable 108 will include, in one form or another, a counterweight 116. The concept of a counterweight is generally well known to those of ordinary skill of the art, as discussed in the "Background" section of this disclosure. In the illustrated example, counterweight 116 is a dedicated component that actually forms a portion of an outer shell of turntable 108. Preferably, the counterweight 116 will be positioned, with respect to the turntable 108, substantially diametrically opposite the boom 106.

Figure 2A:
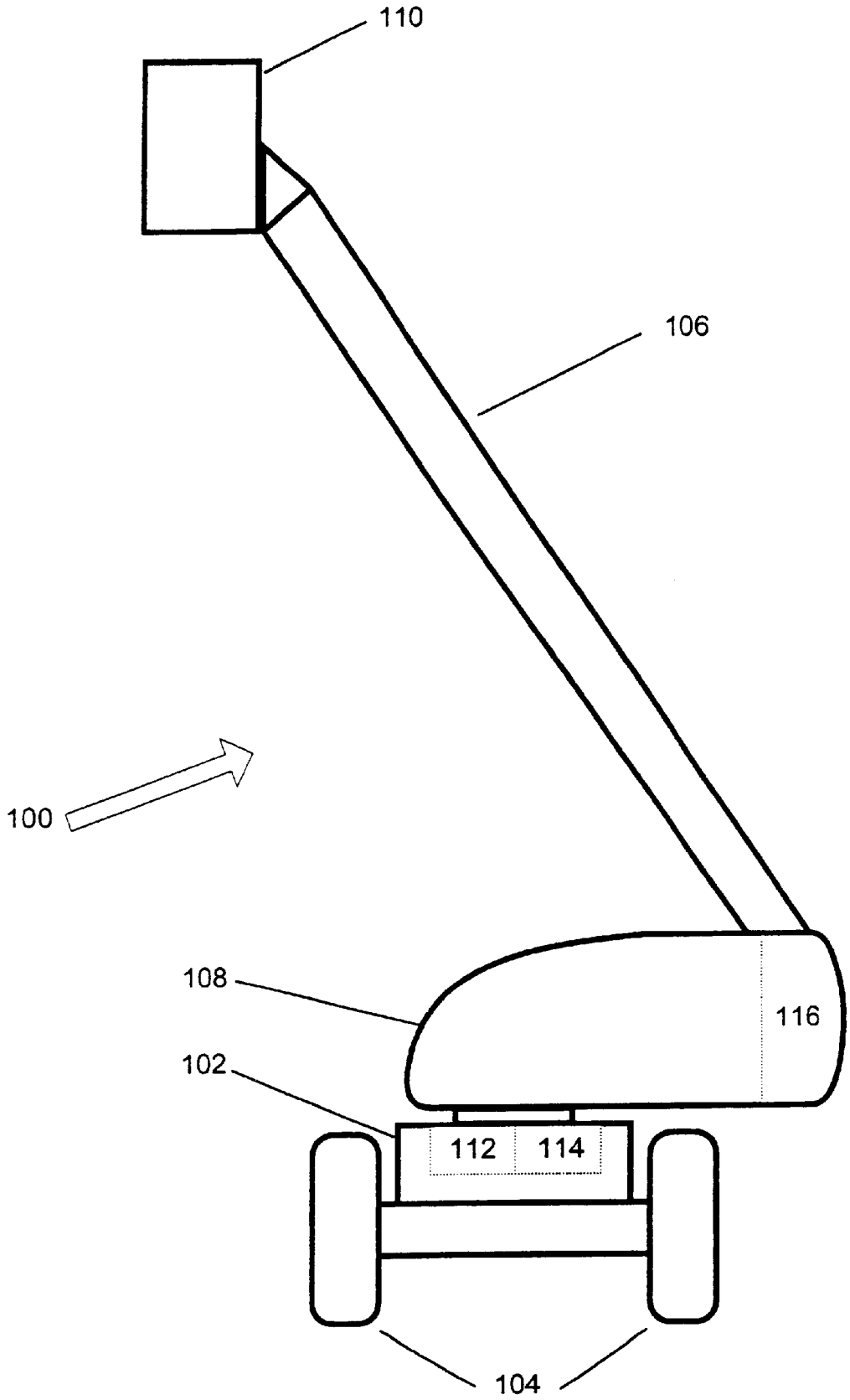
FIG. 2*a* is essentially the same view as FIG. 1, illustrating the boom of the lift structure in a vertically intermediate position.
Figure 2B:
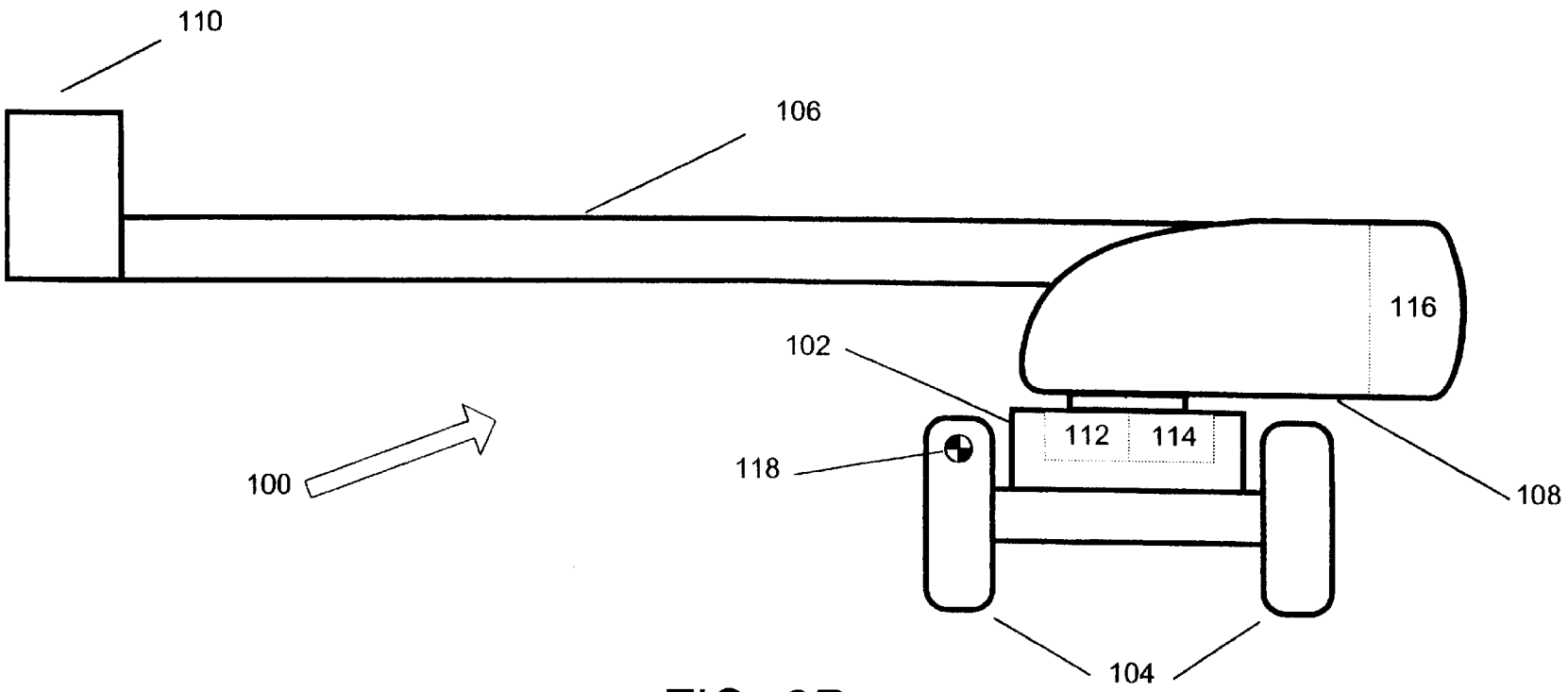
FIG. 2*b* is essentially the same view as FIG. 1, illustrating the boom of the lift structure in a significantly lowered position.
Figure 2C:
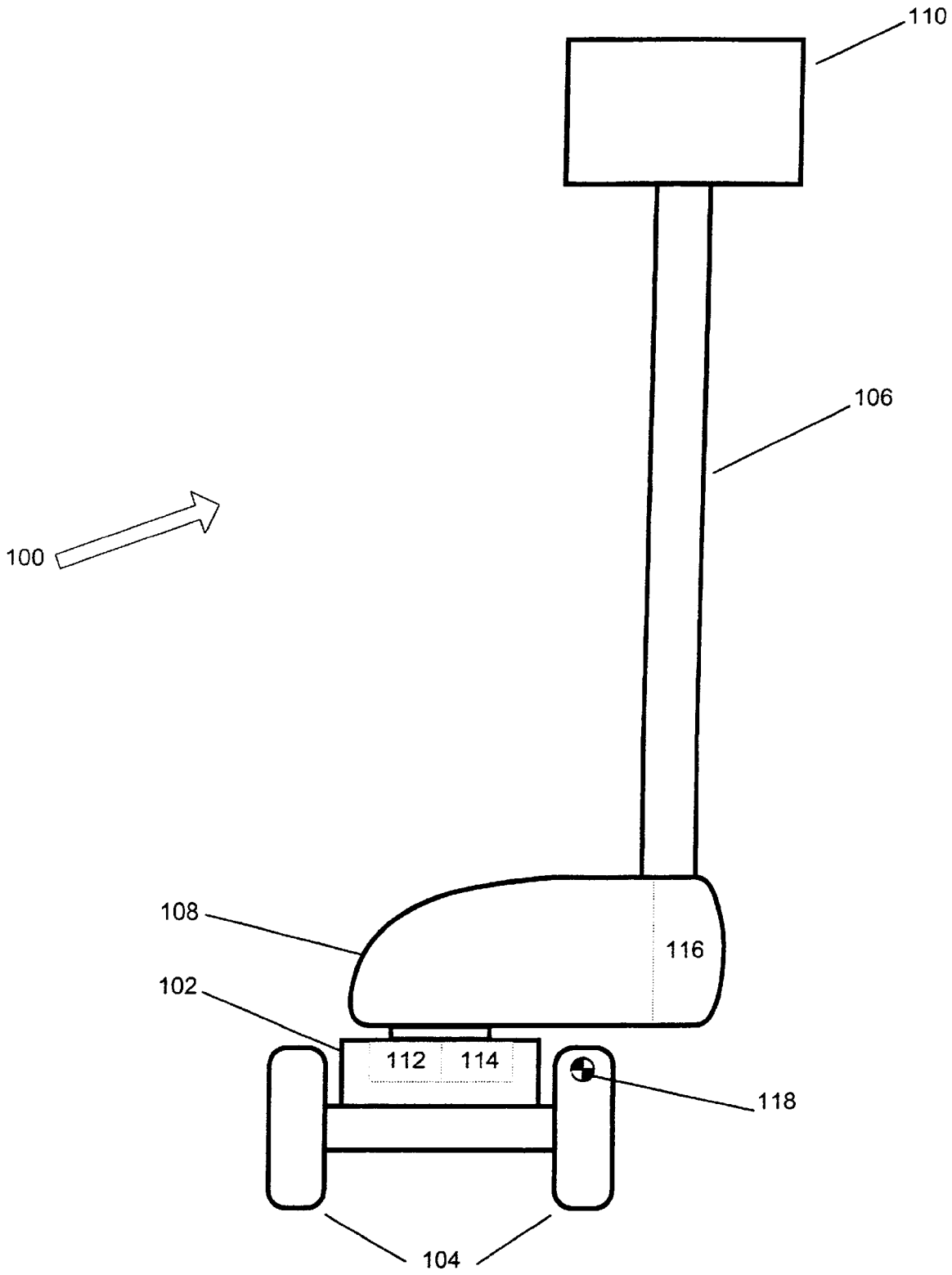
FIG. 2*c* is essentially the same view as FIG. 1, illustrating the boom of the lift structure in a significantly raised position.

In this respect, FIGS. 2*a*, 2*b* and 2*c* schematically illustrate the manner in which such a counterweight 116 conventionally acts. Although a conventional counterweight will act in similar manner irrespective of the relative circumferential positioning (i.e., the "swing" or "slew") of boom 106 with respect to chassis 102, FIGS. 2*a*–2*c*, in similar manner to FIG. 1, illustrate the boom positioned at a horizontal angle of 90 degrees with respect to the longitudinal lie of the lift 100, that is, orthogonal to a direction that defines the drive direction of the lift 100. The reason for illustrating the lift 100 in this manner is that, since this position naturally invites the most unstable configurations for a boom lift 100 where the dimension (i.e., along the drive direction) of the lift is greater than the lateral dimension, the action of counterweight 116 will be better appreciated. Put another way, this is a typical configuration of maximal instability in that the boom lies along a horizontally mapped line that itself is perpendicular to the tipline.

FIG. 2*a* illustrates the boom 106 in an "intermediate" position, in this case approximately 40 degrees. On the other hand, FIG. 2*b* illustrates the boom being positioned substantially horizontally, while FIG. 2*c* illustrates the boom being positioned substantially vertically.

FIGS. 2*b* and 2*c* represent possible extremes of boom elevation, especially as regards the generation of destabilizing moments. In practice, a boom angle below the horizontal is quite common.

Accordingly, the two extremes shown in FIGS. 2*b* and 2*c* typically represent the positions in which a typical boom lift will experience maximum forward and backward instability (as a function of boom angle), respectively. (Although many boom lifts do not elevate as far as a vertical angle of 90 degrees, such an angle is shown in FIG. 2*c* in order to illustrate an extreme position of possible backward instability. The notion of a vertical angle of greater than 90 degrees is not entertained here, as such an angle could be duplicated by changing the boom's horizontal angle by 180 degrees and fixing the boom at a vertical angle of less than 90 degrees. However, the present invention, in accordance with at least one presently preferred embodiment, does not in any way preclude the application of the principles described herein to vertical boom angles of greater than 90 degrees, and in fact encourages the possibility of attaining such angles through the advantage of an increased range of movement that the present invention is believed to afford, as discussed below.)

With regard to forward instability, as illustrated in FIG. 2*b*, it will be noted that a significantly lowered, and extreme outward positioning of platform 110 will naturally contribute to a maximal forward destabilizing moment. One benefit of providing the counterweight 116, then, is to counterbalance this forward destabilizing moment so as to prevent the lift's center of mass 118 from migrating outside the tipline, which would otherwise result in forward tipping. It will be appreciated, then, that it is possible to provide a sufficiently massive counterweight 116 as to adequately counterbalance the maximal destabilizing moment experienced in accordance with the configuration shown in FIG. 2*b*, and to do so in such a manner as to fulfill any requirements (e.g., to account for the presence of one or more individuals on the platform 110, for the positioning of the entire lift vehicle 100 on a given slope, and/or for a required margin of safety).

Turning to FIG. 2*c*, however, it will be appreciated that when the boom 106 is in a significantly raised or even maximally vertical position, the risk of significant backward instability will now present itself. Particularly, given that a counterweight 116 is provided for the purposes described heretofore, it will now unfortunately have the opposite effect, that is, of contributing to instability of the vehicle in a backward direction.

For this reason, it will be appreciated that an appropriate counterbalance for the counterweight, and one which has been used conventionally, is the chassis 102 itself. For this reason, it has been conventional to construct a chassis 102 of such mass as to adequately counterbalance the destabilizing moment provided in the backward direction (possibly contributed to by boom 106, platform 110 [possibly with a load thereon] and counterweight 116), to again prevent the lift's center of mass 118 from migrating outside the tipline, which would otherwise result in backward tipping.

Although the measures described hereinabove with FIGS. 1–2*c* have conventionally been sufficient to reduce the risk of vehicle tipping in either a forward or a backward direction, concern has arisen in the industry over the costs associated with providing an overly massive lift chassis 102. The mass of a lift chassis 102 not only has ramifications in manufacturing costs, but also in transport costs as well as other factors, such as the load that might be applied to fragile surfaces (e.g. mud).

Figure 3:
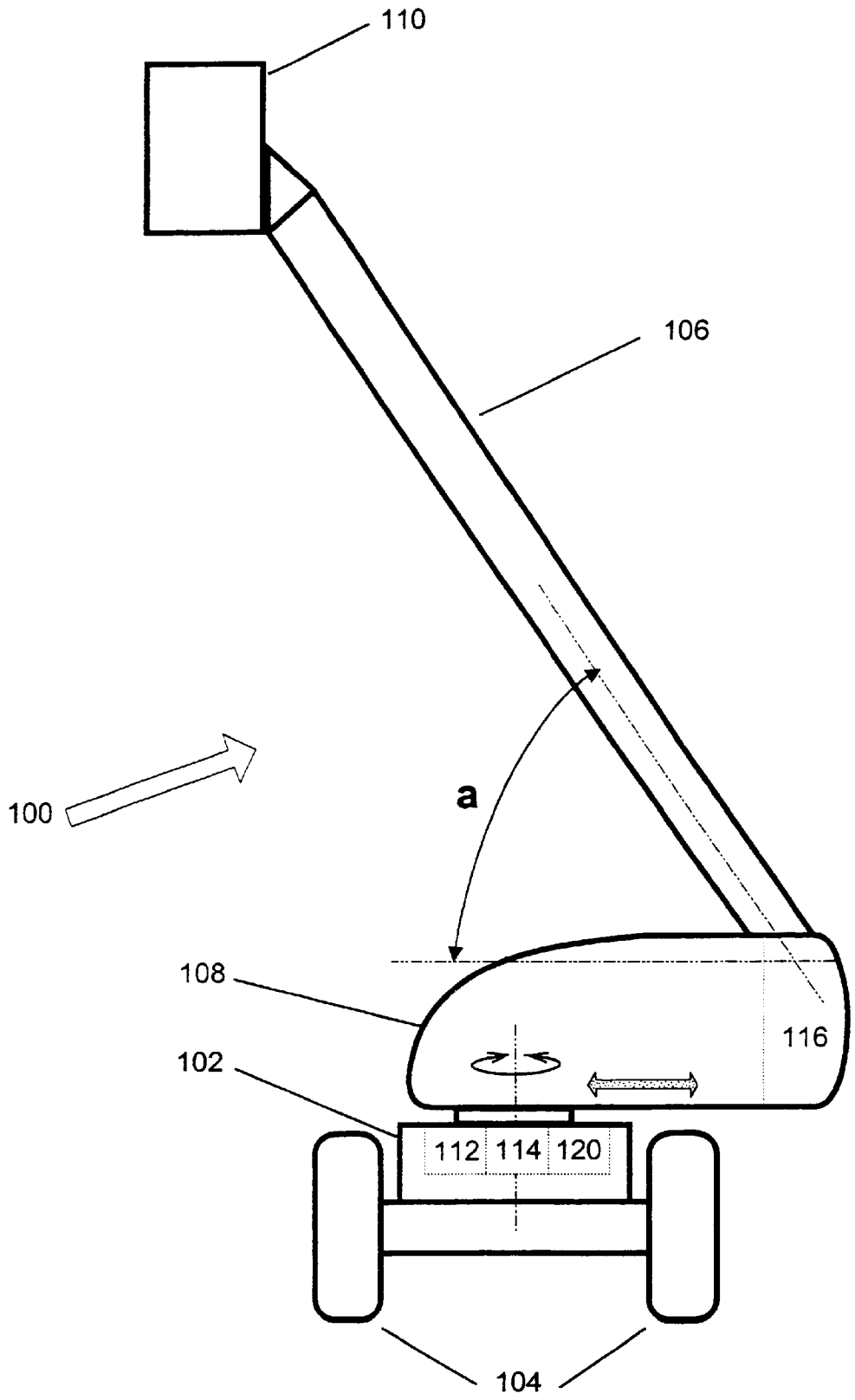
FIG. 3 is a schematic elevational representation of a lift structure, and associated components, according to at least one preferred embodiment of the present invention.
Figure 4A:
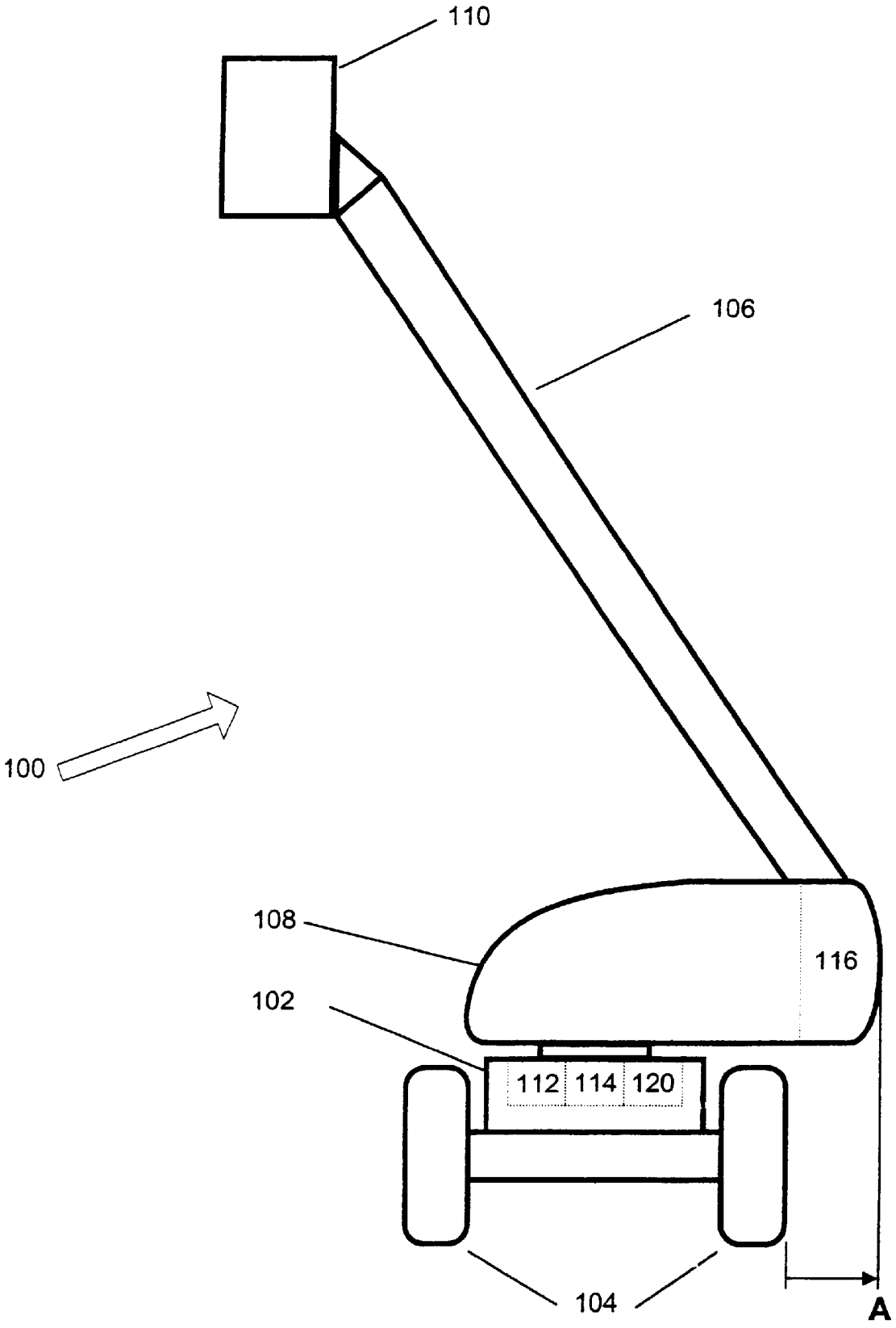
FIG. 4*a* is essentially the same view as FIG. 3, illustrating the boom of the lift structure in a vertically intermediate position.
Figure 4B:
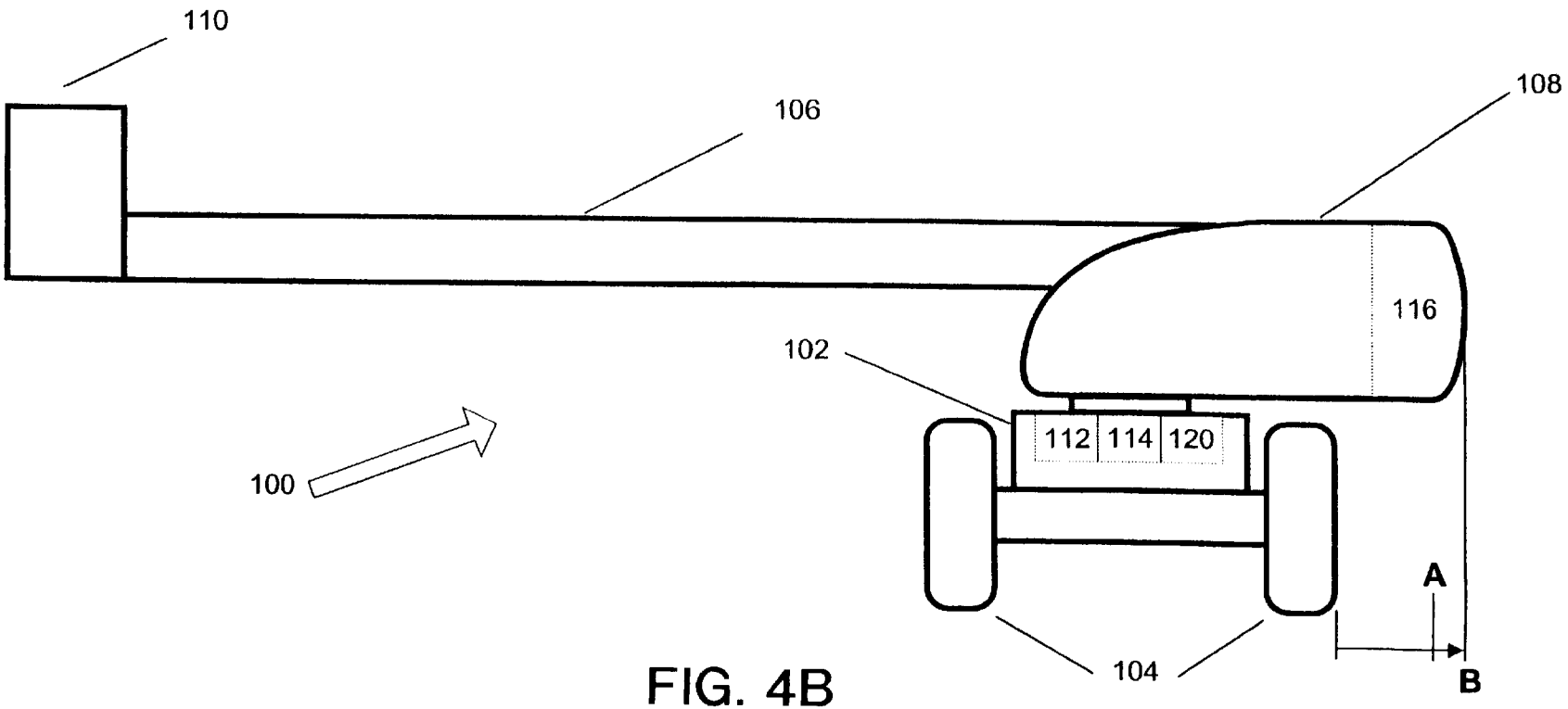
FIG. 4*b* is essentially the same view as FIG. 3, illustrating the boom of the lift structure in a significantly lowered position.
Figure 4C:
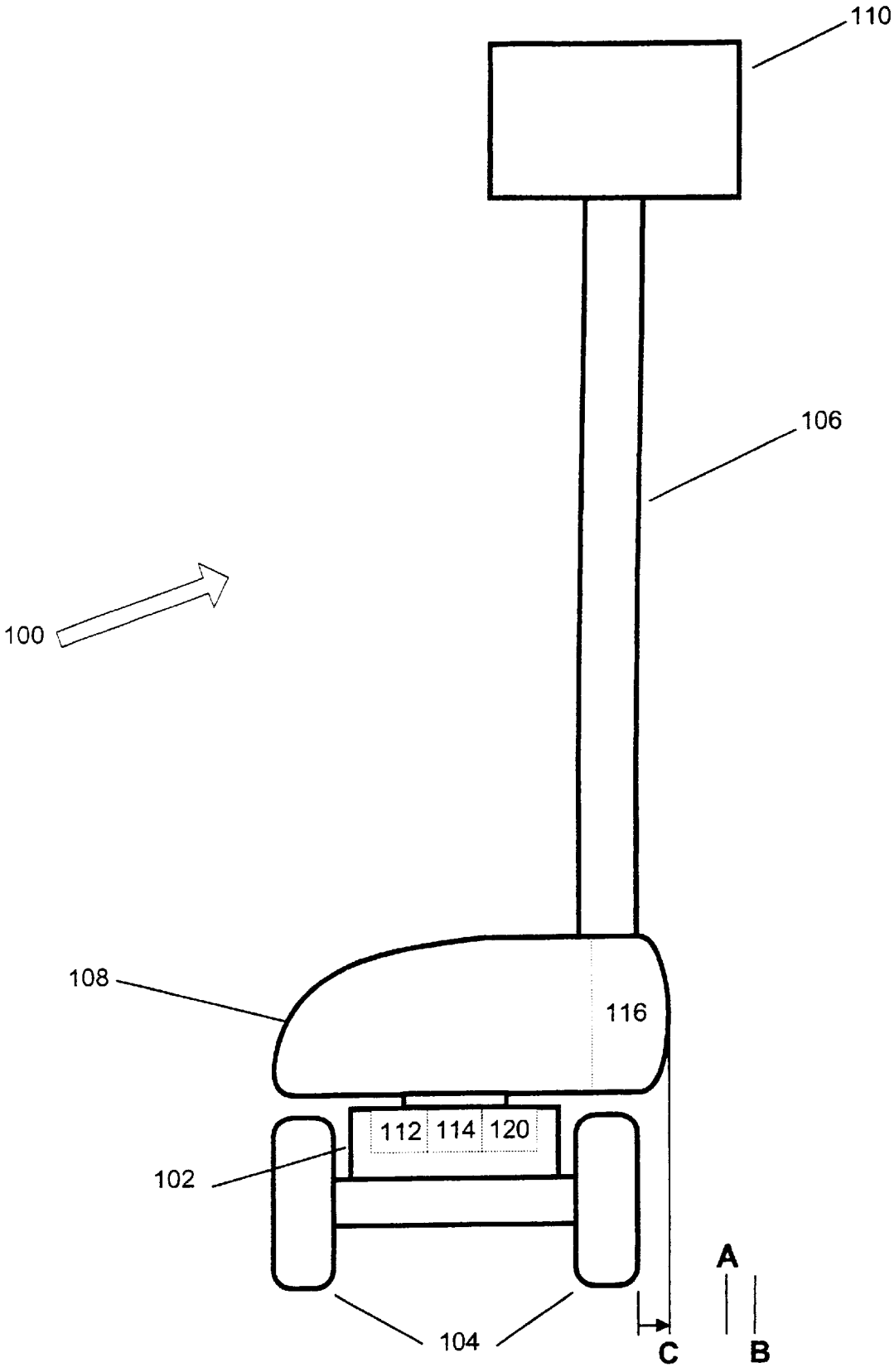
FIG. 4*c* is essentially the same view as FIG. 3, illustrating the boom of the lift structure in a significantly raised position.

A presently preferred embodiment of the present invention, as best illustrated (schematically) in FIGS. 3–4*c*, is believed to help solve this problem, that is, by maintaining the appropriate requirements for a boom lift while effectively reducing the overall mass of a lift structure 100. Preferably, there may be provided a mechanism or arrangement 120 (see FIG. 3) for effecting the horizontal movement of at least a portion of turntable 108. This mechanism 120 may be operatively incorporated with either or both of the drive arrangements 112 and 114 (which in turn may be incorporated with one another), in essentially any suitable manner, in view of t he details provided herebelow.

Accordingly, FIG. 3 is essentially the same view as FIG. 1, but schematically illustrates, via the horizontal arrows, the fact that the turntable 108, or at least a portion thereof, may be movable along a horizontal direction responsive to movement of the boom 106, in a manner to reduce either a forward destabilizing moment or a backward destabilizing moment, as explained herebelow. As a consequence of moving the turntable 108 or portion thereof in this manner, it will be appreciated that an elaborate redistribution of centers of mass takes place, affecting not only the counterweight 116 but also any other components (e.g., the boom 106) having centers of mass that might otherwise contribute to destabilizing movements. Thus, the result of sliding the turntable 108, or portion thereof, is that the stabilizing moments provided by the potentially "destabilizing" components are increased.

Thus, FIG. 4*a* illustrates essentially the same general view as FIG. 2*a*, but establishes that the turntable 108, or at least that portion bearing the dedicated counterweight 116, may be in a first given horizontal position A.

FIG. 4*b*, on the other h and, illustrating essentially the same general view as FIG. 2*b*, shows that the dedicated counterweight 116 has now shifted its horizontal position, thus being disposed more backwardly than in the case of FIG. 4*a*, to a position B, thus counteracting any forward destabilizing moment, both by shifting the boom and its load to a position closer to the forward tipline of the lift, and also by moving the mass of counterweight 116 further away from the forward tipline of the lift.

As shown in FIG. 4*c*, with the boom 106 in a fully vertical position, or a significantly raised position close thereto, the slideable portion of turntable 108 has now shifted to a more forward position C, which has the effect of counteracting (or neutralizing or reducing) the backward destabilizing moment contributed to by boom 106 (with load), counterweight 116, and other components. For this very reason, it is thus possible to utilize a chassis 102 that is of significantly reduced weight, since a smaller stabilizing moment will be required.

In one specific prototype tested in the "60-foot" class of boom lifts, it was possible to reduce the overall weight of the lift by 4920 pounds utilizing the principles discussed above. Particularly, because of the lengths of moment arms involved, it was found that highly favorable results were achieved, in that the weight of the chassis was reduced by 6660 pounds while a dedicated counterweight, such as the counterweight 116 described and illustrated herein, was increased by only 1740 pounds, resulting in a net decrease of 4920 pounds for the entire lift structure. Although an increase in the weight of the counterweight was necessary so as not to compromise forward stability by reducing the weight of the chassis, the advantageously longer moment arm of the counterweight in producing a forward stabilizing moment permitted a much smaller weight for that purpose than would otherwise be required with a more massive chassis. Since the boom lift in question weighed 27,780 pounds, the savings of 4920 pounds resulted in a weight reduction, for the entire boom lift structure, of about 17.7%.

It is to be understood that the arrangements illustrated and described with respect to FIGS. 3–4*c* are provided only as an example and are in no way meant to restrict the scope of the present invention. For example, it is conceivable to utilize any algorithm linking the boom position and the position of the movable portion of turntable 108 that is deemed to be suitable for the application at hand. In this respect, it is to be noted that the present invention need not necessarily be limited to boom lifts. Other applications of the present invention may be found, for example, in the context of excavators (including shovel excavators, jackhammer-type excavators and backhoes), bulldozers, mechanical shovels (including skid-steer mechanical shovels), mechanical pincers, tree harvesters, mobile hydraulic cranes (including mobile hydraulic floor cranes), wheel loaders, tool carriers, boom-mounted derricks (including boom-mounted hydraulic derricks), oil derricks, movable and stationary cranes, and other similar machines.

Although an advantage of reduced chassis weight has been described hereinabove with regard to the provision of a movable turntable portion as described hereinabove, it should be appreciated that a corollary advantage may also be enjoyed. Particularly, if the overall weight of the lift structure 100 is not of particular concern, then it will be appreciated that a prime advantage provided by the inventive movable turntable portion is an increased range of movement of the boom 106. Particularly, for a given fixed weight of a lift structure 100, it is to be noted that the inventive movable turntable portion will permit the boom 106 to be displaced into more extreme positions than in the case of conventional lifts, since there will be reduced risk of instability in such extreme positions as compared to conventional arrangements. Thus, for example, if a conventional lift, possessive of a given weight, were only capable of displacing the boom up to a vertical angle of about 75 degrees before compromising any safety requirements, essentially the same vehicle, possessing essentially the same mass, but provided with the inventive movable arrangement, would be able to afford the displacement of the boom to an even greater vertical angle, possibly 80 degrees or more.

Furthermore, another possible advantage that might be enjoyed in accordance with at least one presently preferred embodiment of the present invention is extended horizontal reach. Particularly, it is believed that the inventive movable arrangement will now permit the use of telescopic booms (or possibly even articulated booms) that are longer in reach, and thus more massive, since the additional moments provided by additional mass in a longer boom, and the additional moment arm attributed to the work platform and the load it carries, can be neutralized in view of the shifting masses described heretofore. Thus, since a longer boom can now be used, greater horizontal reach can be achieved at all vertical angles of the boom structure.

It will be appreciated that the present invention need not necessarily be restricted to a context in which a turntable 108 is utilized. Indeed, it is possible for the present invention to be utilized in a context in which there is a vertically pivotable boom 106 but in which its vertical pivot support is fixed with respect to a circumferential direction. In this manner, it is still possible to slide a movable portion of the lift back and forth in response to the position of the boom and still enjoy the benefits of overall reduced weight.

There are many ways in which a functional interconnection can be achieved between the movement of the boom 106 and the movement of a movable turntable portion. Mechanical linkages are, of course, conceivable, but it is also possible to utilize an electronic arrangement for communicating an algorithm to a mechanical interconnection between the boom 106 and the turntable 108. For example, an appropriately positioned and configured sensor arrangement could detect the angle of the boom 106 and thence transmit this information to an appropriately configured drive 120 dedicated to the translational movement of the movable turntable portion. Based on a predetermined or preprogrammed algorithm, at least a portion of the turntable 108 could translate in response to the measured position of the boom 106.

Figure 5:
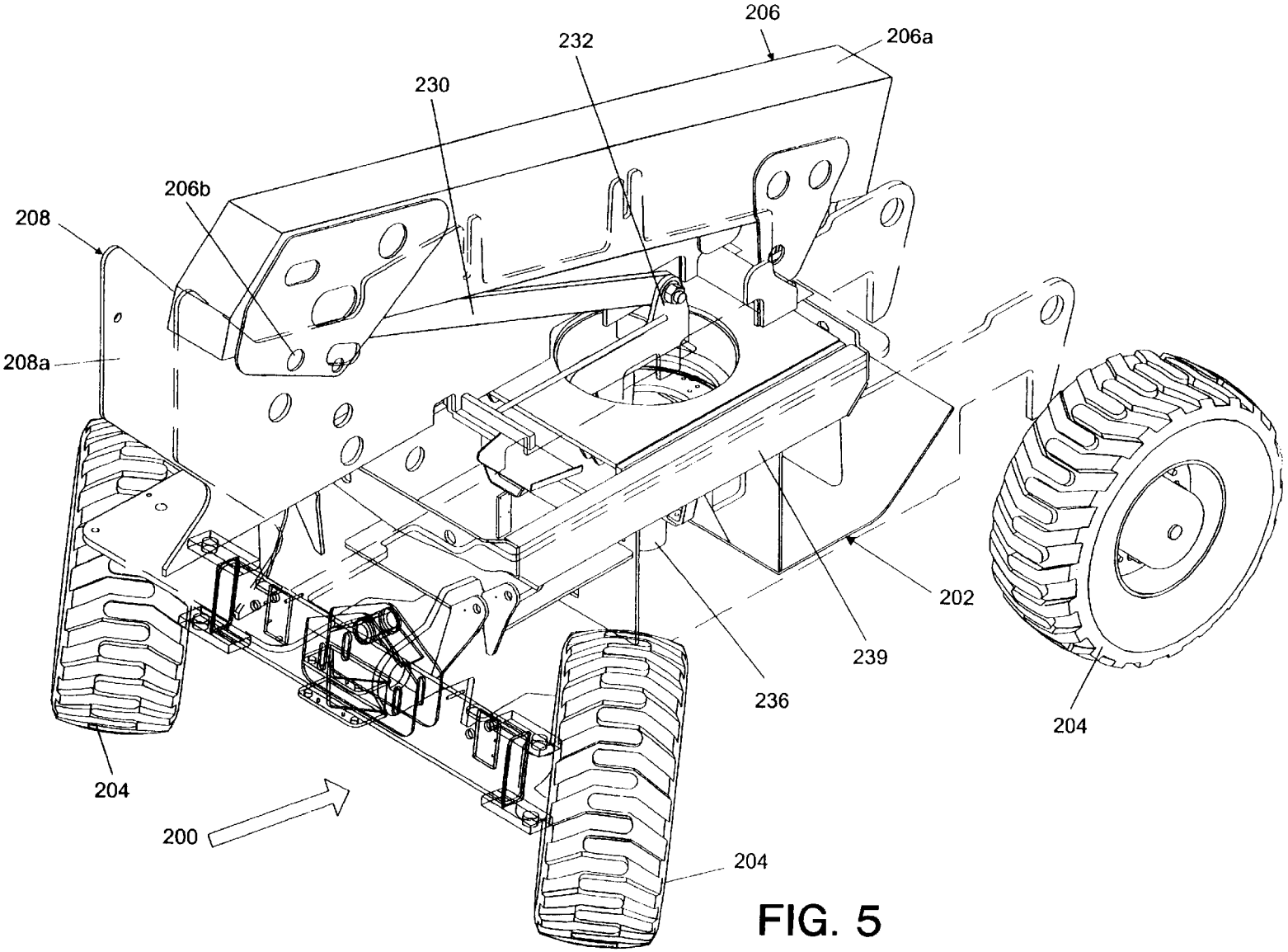
FIG. 5 is a perspective representation of selected components of a boom lift according to at least one preferred embodiment of the present invention.
Figure 6:
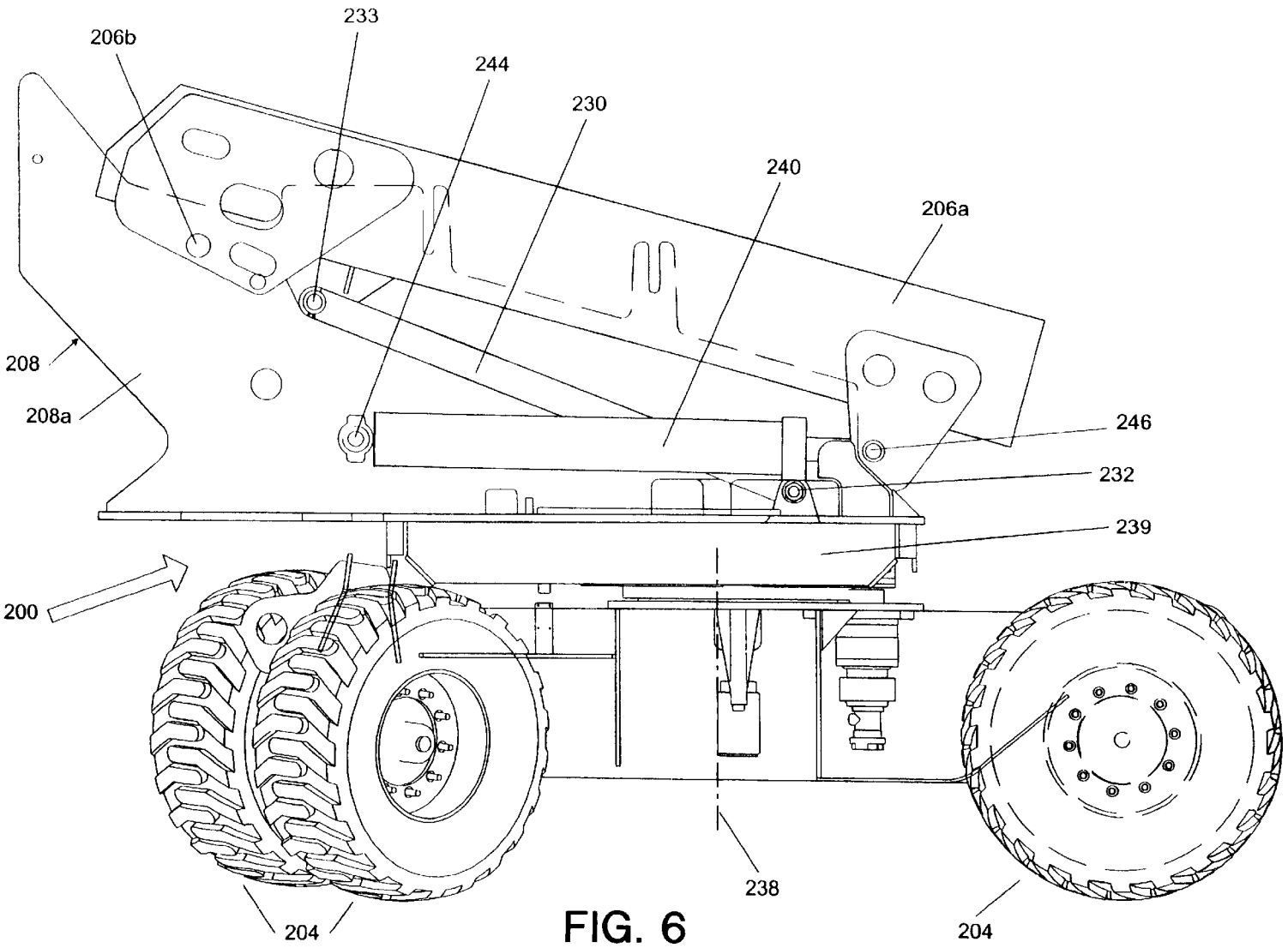
FIG. 6 is a side elevational representation of essentially the same boom lift as illustrated in FIG. 5, illustrating a boom portion in a significantly lowered position.
Figure 7:
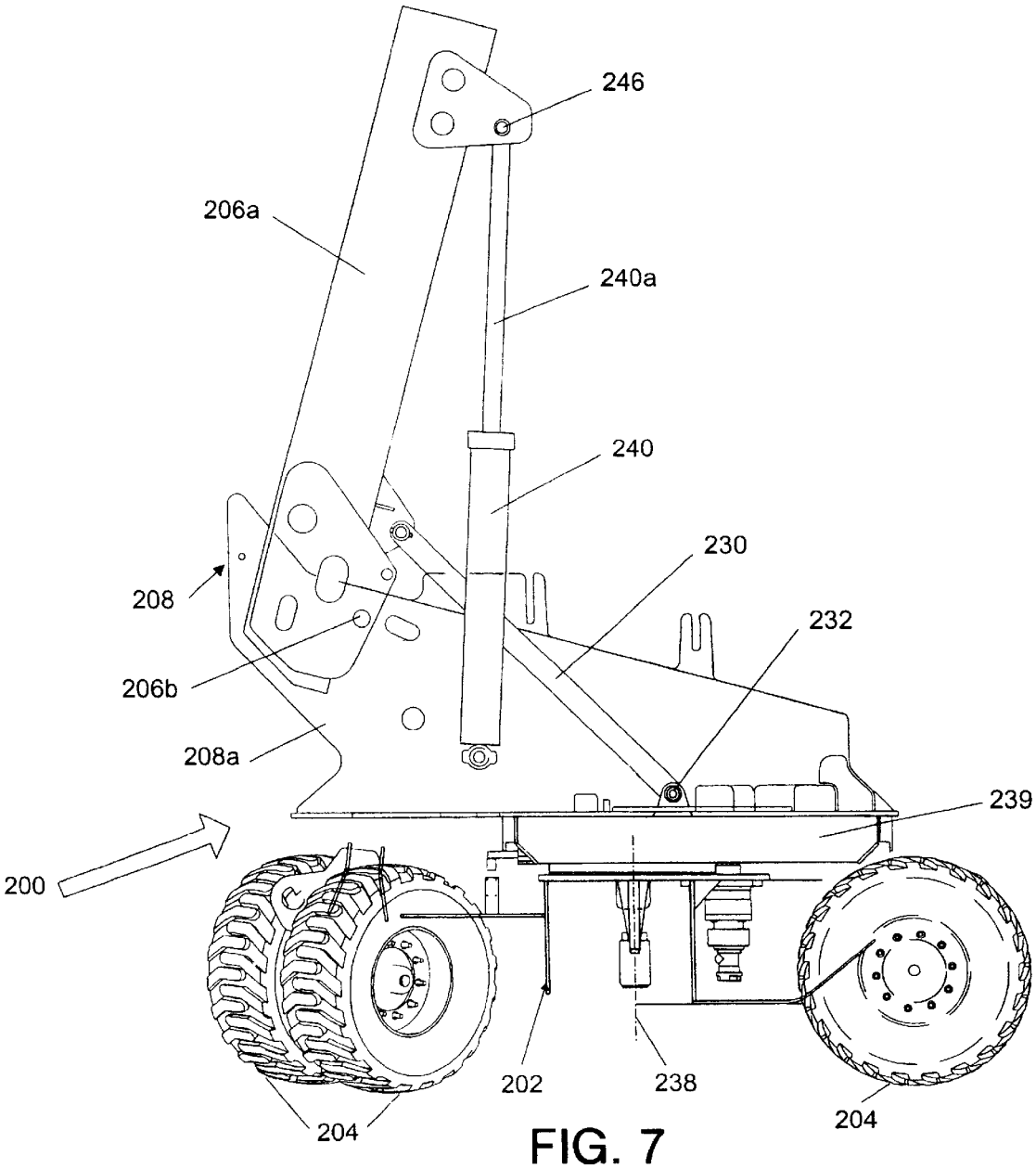
FIG. 7 is essentially the same view as FIG. 6, illustrating a boom portion in a significantly raised position.

A presently preferred embodiment of the present invention involves a purely mechanical linkage between a boom and a portion of a turntable, as discussed herebelow with respect to FIGS. 5–7, wherein the mechanical linkage actually serves to assert a positioning algorithm.

FIG. 5 illustrates, in perspective view, components of a boom lift 200 employing a mechanical linkage according to an embodiment of the present invention. As shown, vehicle chassis 202 may be supported on four wheels 204 (three of which are shown). Again, skids, tracks or a fixed arrangement could easily substitute for wheels 204. A main boom portion 206*a* of a boom 206 may preferably be pivot-mounted, at pivot point 206*b*, on a flange portion 208*a* of turntable 208. Flange portion 208*a* may preferably be so configured as to provide adequate support for a turntable counterweight.

According to an embodiment of the present invention, a linkage 230 is preferably connected between boom portion 206*a* and a pivot mount 232. The location of pivot mount 232 will be explained further below.

In accordance with at least one presently preferred embodiment of the present invention, turntable 208 may preferably include at least one slideable portion and at least one non-slideable portion. The slideable and non-slideable portions will each, of course, be configured and arranged to rotate with respect to chassis 202. Accordingly, pivot mount 232 will preferably constitute part of the non-slideable portion of turntable 208, while turntable flange 208*a* will preferably constitute part of the slideable portion of the turntable.

All turntable components will preferably be configured to rotate about turntable pivot 236, particularly about rotational axis 238 (see FIG. 6). Also shown in FIG. 5 are rails 239 of turntable 208. These components will be better appreciated and understood with regard to the views shown in FIGS. 6 and 7.

Accordingly, FIG. 6 is a side view of essentially the same components shown in FIG. 5, but with sore additions. Indicated at 240 is a lift cylinder that is pivot-mounted at pivot point 244 on turntable flange 208*a*, while also being pivot-mounted, at pivot mount 246, with respect to boom portion 206*a*. Thus, it will be appreciated that, whereas link 230 extends between boom portion 206*a* and a non-slideable portion (232) of turntable 208, lift cylinder 240 extends between boom portion 206*a* and a slideable portion (208*a*) of turntable 208. Accordingly, it will be appreciated that, upon movement of lift cylinder 240 to either raise or lower the boom portion 206*a*, a sliding displacement of all slideable portions of turntable 208 (including flange 208*a*) will occur.

In FIG. 6, the boom portion 206*a* is in a lowermost, or "stowed" position. However, in FIG. 7, boom portion 206*a* is shown as being in a significantly raised position. The relative sliding displacement that has taken place in the interim can best be appreciated by comparing the relative positions of rotational axis 238 and rails 239 in both of the FIGS. 6 and 7. Thus, it will be appreciated that the length of mechanical link 230, as well as the position of the connecting pivot points 232 and 233, will, along with the dimensions and connection points of lift cylinder 240, govern the manner in which the slideable portion of turntable 208 slides with respect to both the chassis 202 and the non-slideable portion of turntable 208.

An algorithm that has been found to be highly effective and that might be utilized, in accordance with a preferred embodiment of the present invention, in conjunction with the mechanical linkage described and illustrated with respect to FIGS. 5–7, may be expressed by way of the following equation:

$$d = d_0 + x_0 - r\cos(\theta - \psi) - \sqrt{l^2 - [y_0 + r\sin(\theta - \psi)]^2}$$

where:

d:translational displacement

θ:boom vertical angle $d_0$:translational displacement for θ=0

$x_0$:horizontal distance between boom pivot and link lower pivot $y_0$:vertical distance between boom pivot and link lower pivot l:link length between pivots r:distance between boom pivot and link upper pivot ψ:angle between horizontal and line that passes through boom pivot and link upper pivot Additionally, Table I provides data obtained with a prototype lift in accordance with an embodiment of the present invention, illustrating the sliding (or translational) distance undertaken by a movable turntable portion for given lift angles of a boom:

TABLE I

| Boom Angle (Degrees) | Translation Distance (inches) |
|---|---|
| −15 | 0.00 |
| −14 | −0.03 |
| −12 | −0.04 |
| −10 | −0.03 |
| −8 | 0.00 |
| −6 | 0.07 |
| −4 | 0.16 |
| −2 | 0.28 |
| 0 | 0.43 |
| 2 | 0.61 |
| 4 | 0.81 |
| 6 | 1.05 |
| 8 | 1.31 |
| 10 | 1.60 |
| 12 | 1.91 |
| 14 | 2.26 |
| 16 | 2.63 |
| 18 | 3.02 |
| 20 | 3.45 |
| 22 | 3.90 |
| 24 | 4.37 |
| 26 | 4.87 |
| 28 | 5.39 |
| 30 | 5.94 |
| 32 | 6.50 |

TABLE I-continued

| Boom Angle (Degrees) | Translation Distance (inches) |
|---|---|
| 34 | 7.09 |
| 36 | 7.70 |
| 38 | 8.33 |
| 40 | 8.98 |
| 42 | 9.65 |
| 44 | 10.33 |
| 46 | 11.03 |
| 48 | 11.74 |
| 50 | 12.46 |
| 52 | 13.20 |
| 54 | 13.95 |
| 56 | 14.70 |
| 58 | 15.46 |
| 60 | 16.23 |
| 62 | 17.00 |
| 64 | 17.78 |
| 66 | 18.56 |
| 68 | 19.34 |
| 70 | 20.11 |
| 72 | 20.89 |
| 74 | 21.66 |
| 75 | 22.04 |

Generally, it is to be understood that any algorithm that might be used for governing the interrelationship between one characteristic of the lift, such as boom angle, to another characteristic, such as the horizontal position of the slideable portion 208*a* of turntable 208, may be tailored to the machine in question, depending upon the needs of the user. To this end, then, it is possible to alter the dimensions, orientation or positioning of a mechanical link, such as link 230, to assert the algorithm desired.

It is also conceivable, within the scope of the present invention, to utilize a mechanical linkage that is not a fixed link. As one example, it might be possible to replace the mechanical link 230 discussed heretofore with a hydraulic cylinder or any other conceivable type of variable-length link. Additionally or alternatively, it is possible to utilize a link that disengages or engages (i.e., becomes effective) only when certain conditions are met. Thus, it is conceivable to utilize a link that will interconnect, for example, a portion of a boom and a portion of a turntable or superstructure over a given range of boom angles but will disengage over a different range of boom angles. Any of several different possible arrangements could be used in this manner.

It is to be understood that the present invention is not meant to be restricted to the concept of shifting a turntable portion merely in response to the boom angle. In fact, it is conceivable to shift a counterweight in response to essentially any movement of a boom, such as strictly circumferential movement or a combination of vertical and circumferential movement. In this vein, it will be appreciated that, on a typical boom lift, in which a chassis does not exhibit complete rotational symmetry of mass, it is conceivable to shift a counterweight as a function of circumferential position of the boom in order to compensate for variations in instability that occur as a function of the circumferential position of a boom. The present invention broadly contemplates any possible types of mechanical linkage that might be used for this purpose, although it would appear that an electronic input to a mechanical linkage would be particularly wellsuited for this purpose.

It is conceivable, within the scope of the present invention, to shift the position of a boom in response to changing boom conditions, rather than, or in addition to, shifting a counterweight or movable turntable portion. As one possible example of this, it is conceivable to provide two or more different mechanical linkages with the effect of configuring two or more discrete objects to move at two different rates or in accordance with two different algorithms. Of course, it will be appreciated that i n the preferred embodiment of the present invention described heretofore, the boom 206 actually moves along with the sliding portion 208*a* of turntable 208 as part of an elaborate and highly effective redistribution of various masses on the boom lift 200.

In at least one presently preferred embodiment of the present invention, it will be appreciated that a suitably arranged mechanical linkage can assert a one-to-one correspondence between the vertical angle of the main boom portion 206*a* and the horizontal position of the turntable. In other words, the mechanical linkage can assert one and only one possible horizontal position of the slideable turntable portion 208*a* for each possible boom angle. In this vein, the one-to-one correspondence need not necessarily be linear. However, it is conceivable to provide a mechanical, and certainly electronic, linkage that does not necessarily effect a one-to-one correspondence. Particularly, it is conceivable to create a mechanical or electronic linkage that ensures that, for example, for a given lower range of vertical angles, the movable turntable portion 208*a* will not displace horizontally at all, but will only do so beyond a given threshold angle.

It is to be appreciated that the relationship between the vertical angle and the horizontal position of the turntable could be linear or non-linear. In the specific algorithmic example described heretofore, it will be noted that there is a cosine relationship between the two variables. Thus, essentially any arrangement for asserting a positional relationship between the boom position and the movable turntable portion position is conceivable within the scope of the present invention.

It will be appreciated that, although the specific embodiments illustrated herein involve the use of only a simple single boom (e.g., a telescoping single boom), the same principles can be applied in conjunction with an articulated boom, as is often found in the industry. It is conceivable to peg the movement of the movable turntable portion 208*a* to the movement of any portion of a multi-segmented boom, and it need not necessarily be the "tower" segment (i.e., that segment that extends from the chassis or other main structure) Furthermore, movement of the movable turntable position could be governed by the composite movement of different segments of an articulated boom, according to a predetermined algorithm that is asserted either mechanically or electronically. However, in at least one present preferred embodiment of the present invention, it will be noted that the governing factor for dictating the position of the movable turntable portion, is what may be termed the "lift angle" of the boom, or that vertical angle formed by the main segment of the boom, extending from the chassis or other main frame, with respect to the horizontal.

Figure 8:
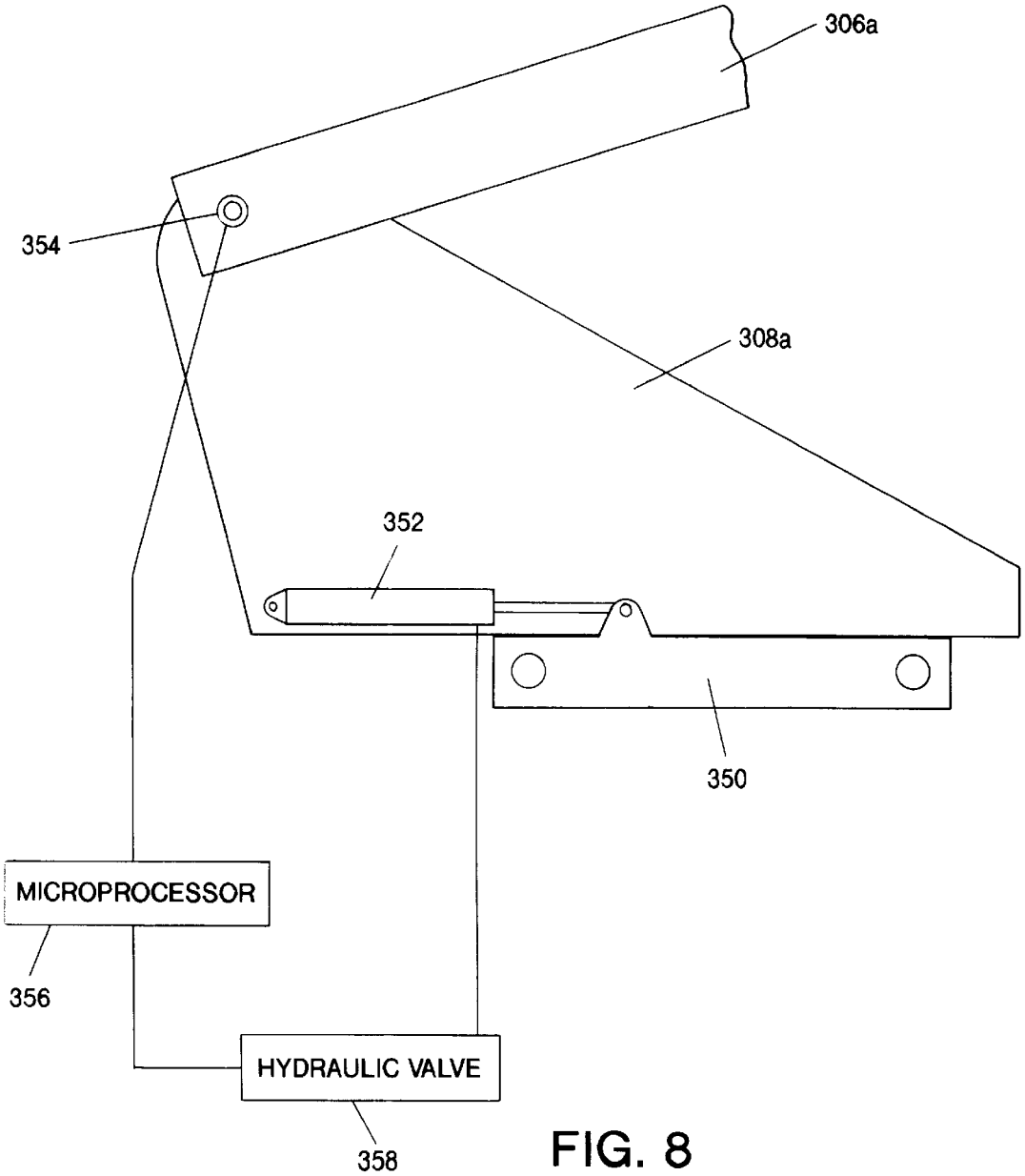
FIG. 8 illustrates an alternative embodiment of the present invention, in which electronic feedback is utilized to control the positioning of a movable turntable portion.

If any electronic input to a mechanical linkage is utilized, it will be appreciated that there are several manners in which an algorithm can be effected. A look-up table is one possibility. FIG. 8 illustrates an example.

Thus, in accordance with an alternative embodiment of the present invention, FIG. 8 illustrates a pivotable boom portion 306*a* mounted on a movable turntable portion 308*a*. Indicated at 350 is a mounting block from which a hydraulic cylinder 352 extends to be connected to movable turntable portion 308*a*. Preferably, movable turntable portion 308*a* will be so mounted and configured as to be capable of sliding in response to extension of cylinder 352.

A sensor 354 may be provided at the pivot point between boom portion 306*a* and movable turntable portion 308*a*, for the purpose of reporting to microprocessor 356 a physical parameter (e.g., the lift angle) relating to boom portion 306*a*. Microprocessor 356, conceivably containing a lookup table or algorithm for this purpose, may then transmit to a hydraulic valve 358 a signal that urges a given action of hydraulic valve 358 as a function of the position of boom portion 306*a*, to consequently cause cylinder 352 to retract or extend and thus reposition movable turntable portion 308*a*.

It is also conceivable to utilize a hybrid mechanical and electronic linkage in order to peg the movement of a movable turntable portion to that of a boom. As one possible example, a "gross" pattern of motion could be asserted by a mechanical linkage, to be followed up by a "fine-tuning" of the positional relationship by way of an electronic input to a mechanical linkage. In another possible example, a mechanical linkage could be used to assert a positional relationship over a given range of boom angles or other physical values, only to be replaced by an electronic input to a mechanical linkage over another range of angles or other physical values.

It is conceivable, within the scope of the present invention, to govern the position of the movable turntable portion with regard to factors associated with the boom other than the position of the boom. For instance, it is possible to use the personnel or material weight present on the platform as a factor for determining the position of the movable turntable portion. For instance, it is possible to measure the load present on the platform and then alter the position of the movable turntable portion accordingly in order to maintain adequate stability.

To carry out such an embodiment, for example, it is conceivable to utilize weight sensors appropriately positioned on the platform to transmit data back to an electronic input mechanism (for a controlling mechanical linkage). The result could be an instantaneous redefinition of the permissible "envelope" within which the lift is able to operate. Such an arrangement, of course, could be utilized by itself in governing the position of the movable turntable portion or could be used in addition to any arrangement in which the movable turntable portion position is controlled by position of the boom. For example, in addition to altering the position of the movable turntable portion based on the load applied to the work platform, the position of the movable turntable portion could also be altered as a function of the lift angle of the boom and/or of the degree that one or more portions of the boom telescopes.

Also, when the concept is discussed herein of controlling the position of the counterweight via the position of the boom, it is to be understood that this covers a very wide range of concepts. Particularly, it will be noted that many booms involve movable components that move independently of the action of the main boom and are thus independent of the vertical angle of the main boom. Such components include, but are not limited to, for example, rotatable platforms, telescoping platforms, segmented booms, etc. In such instances, movement of the movable turntable portion could conceivably govern by, at least in part, the movement of such components. For example, if a platform is extendible with respect to the main boom segment or segments, its position could conceivably be utilized as a factor in determining the position of the movable turntable portion. A mechanical or electronic linkage could be provided to ensure such governance. It is conceivable to govern the position of the movable turntable portion on the basis of only one such factor or on several such factors, any or all of which could be utilized in combination with the concept of governing the position of the movable turntable portion on the basis of the position of a main or primary boom segment, such as that segment which is pivoted directly on the chassis or other main frame. Accordingly, it will be appreciated that the present invention, in accordance with at least one presently preferred embodiment, broadly contemplates essentially any arrangement in which a stabilizing moment is imparted to a lift-type structure on the basis of at least one state of at least a portion of the boom.

It will also be appreciated that the present invention contemplates essentially any arrangement in which a stabilizing moment is imparted to a lift. In this manner, it is possible to provide an arrangement in which there is not a dedicated counterweight imparting a stabilizing moment, but some other means for doing so. As one possible example, there could exist one or more fluid tanks on the boom lift 200, and a transfer of mass could take place by redistributing the fluid among different portions of the lift. In principle, it will be appreciated that such a redistribution of fluid can be regarded as being essentially analogous to the sliding action of a movable turntable portion, as discussed heretofore.

Although the present invention may be utilized in a wide variety of contexts, its advantages may be appreciated, in non-restrictive fashion, with respect to a boom lift structure. As discussed previously, it has been found, for example, that a prototype boom lift structure employing a "sliding turntable portion" design as described and illustrated hereinabove, could represent a savings in weight of about 18% in the lift as compared to a conventional arrangement in which no portion of the turntable is able to slide.

It is conceivable, within the scope of the present invention, to apply the general principles discussed herein to essentially any type of load carrier, such as a vehicle. Particularly, the present invention, in accordance with at least one presently preferred embodiment, contemplates a load carrier having a load bearing portion and an arrangement for imparting to the load carrier a stabilizing force, based on at least on state of the load-bearing portion, for averting destabilization of the load carrier.

Furthermore, the present invention, in accordance with at least one presently preferred embodiment, broadly contemplates a load carrier including an arrangement for responsively redistributing mass based on at least one state of at least a portion of the load carrier. Such responsive redistributing could, for example, be carried out instantaneously, virtually instantaneously, or in a matter of very little time.

Additionally, the present invention, in accordance with at least one presently preferred embodiment, broadly contemplates a load carrier including an arrangement for automatically redistributing mass based on at least one state of at least a portion of the load carrier. Such automatic redistributing could be carried out by essentially any conceivable means.

It is to be understood that the present invention, in accordance with a t least one presently preferred embodiment, may find application s in a wide variety of contexts, many of which have been mentioned and described heretofore. An oil derrick would appear to be a pertinent example in this regard, since the structural supports tend to be firmly anchored in a solid surface.

In such contexts (i.e., oil derricks and other stationary arrangements), the present invention, in accordance with at least one presently preferred embodiment, could be employed to reduce structural loading on the stationary frame being employed, which would essentially be analogous to counteracting destabilizing moments on a lift having supports (e.g., wheels or free stationary members) that are not fixed.

If not otherwise stated herein, it may be assumed that all components and/or processes described heretofore may, if appropriate, be considered to be interchangeable with similar components and/or processes disclosed elsewhere in the specification, unless an express indication is made to the contrary.

If not otherwise stated herein, any and all patents, patent publications, articles and other printed publications discussed or mentioned herein are hereby incorporated by reference as if set forth in their entirety herein.

It should be appreciated that the apparatus and method of the present invention may be configured and conducted as appropriate for any context at hand. The embodiments described above are to be considered in all respects only as illustrative and not restrictive. The scope of the invention is defined by the following claims rather than the foregoing description. All changes which come within the meaning and range of equivalency of the claims are to be embraced within their scope.

What is claimed is:

1. Load-bearing apparatus comprising:

a reference portion;

an arm support portion;

a pivot mount disposed on said arm support portion;

a load-bearing arm being pivotably mounted on said arm support portion at said pivot mount;

said arm support portion being translatable with respect to said reference portion; and a motion linking arrangement for linking motion of said arm support portion with motion of said load-bearing arm;

said motion linking arrangement being adapted to simultaneously translate said arm support portion, said pivot mount and said load-bearing arm with respect to said reference portion in response to motion of said load-bearing arm and in accordance with a predetermined algorithm that governs the simultaneous translation of said arm support portion, said pivot mount and said load-bearing arm in response to motion of said load-bearing arm, whereby:

a stabilizing moment is imparted to said apparatus as motion of said load-bearing arm causes said apparatus to approach a position of critical backward instability; and a stabilizing moment is imparted to said apparatus a motion of said load-bearing arm causes said apparatus do approach a position of critical forward instability.

2. The apparatus according to claim 1, wherein said motion linking arrangement comprises a mechanical operational connection between said load-bearing arm and said reference portion.

3. The apparatus according to claim 2, wherein said mechanical operational connection comprises a discrete mechanics link between said load-bearing arm and said reference portion.

4. The apparatus according to claim 1, wherein said motion linking arrangement comprises a non-mechanical operational connection between said arm support portion and said reference portion.

5. The apparatus according to claim 1, wherein said motion linking arrangement comprises a hybrid mechanical and non-mechanical operational connection between said arm support portion and said reference portion.

6. The apparatus according to claim 1, wherein said motion linking arrangement is adapted to simultaneously translate said arm support portion, said pivot mount and said load-bearing arm with respect to said reference portion at least as a function of a vertical angle of said load-bearing arm.

7. The apparatus according to claim 1, wherein said motion linking arrangement is adapted to simultaneously translate said arm support portion, said pivot mount and said load-bearing arm with respect to said reference portion at least as a function of a telescoping length of said load-bearing arm.

8. The apparatus according to claim 1, wherein said motion linking arrangement is adapted to simultaneously translate said arm support portion, said pivot mount and said load-bearing arm with respect to said reference portion at least as a function of a vertical angle and a telescoping length of said load-bearing arm.

9. The apparatus according to claim 1, wherein said load-bearing apparatus is a boom lift.

10. The apparatus according to claim 1, further comprising:

a turntable for positioning said load-bearing arm at a predetermined swing angle; and said turntable comprising said reference portion and said arm support portion.

* * * * *

UNITED STATES PATENT AND TRADEMARK OFFICE

CERTIFICATE OF CORRECTION

PATENT NO.: 6,098,823

DATED: August 8, 2000

INVENTOR(S): Yahiaoui

It is certified that errors appear in the above-identified patent and that said Letters Patent is hereby corrected as shown below:

Column 16, line 48, in Claim 1, delete second "a" and replace with "an".

Column 16, line 50, in Claim 1, delete "do" and replace with "to".

Column 16, line 57, in Claim 3, delete "mechanics" and replace with "mechanical".

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*